US005483753A

United States Patent [19]

Boivin et al.

[11] Patent Number: 5,483,753

[45] Date of Patent: Jan. 16, 1996

[54] RESILIENT ROTARY DRYER SEAL

[75] Inventors: Robert M. Boivin; Ravindran Nadarajah, both of Vancouver, Wash.; John E. Rude, Lake Oswego; Kenneth J. Zimmerman, Milwaukie, both of Oreg.

[73] Assignee: Beloit Technologies, Inc., Wilmington, Del.

[21] Appl. No.: 383,623

[22] Filed: Feb. 6, 1995

[51] Int. Cl.[6] ..... F26B 25/00

[52] U.S. Cl. ..... 34/242; 34/601

[58] Field of Search ..... 34/242, 601, 135, 34/136, 137

[56] References Cited

U.S. PATENT DOCUMENTS

| | | | |
|---|---|---|---|
| 2,840,922 | 7/1958 | Erisman et al. | 34/135 |
| 2,904,896 | 9/1959 | Forrest et al. | 34/136 |
| 3,875,686 | 4/1975 | Smoot | 34/242 |
| 3,940,239 | 2/1976 | Smoot et al. | 34/242 |
| 4,052,797 | 10/1977 | Christensen | 34/242 |
| 5,256,061 | 10/1993 | Cress | 34/242 |

*Primary Examiner*—John T. Kwon

*Attorney, Agent, or Firm*—Dirk J. Veneman; Raymond W. Campbell

[57] ABSTRACT

A drum dryer seal is built up of six layers of high temperature ceramic cloth that form a blanket. The top layer is aluminized, high temperature barrier yarn, to prevent air from passing through the seal. The blanket is clamped to a bracket on the non-rotating portion of the dryer by a clamp consisting of a clamping strip and a plurality of clamping bolts. The clamping bolts may also hold a plurality of C-shaped spring retention brackets, the upper leg of each holds a resilient spring. The springs overlie the sealing ring. A plunger is mounted on the spring which is positioned over a sealing ring. The plungers bias the blanket against the sealing ring. An alternative embodiment employs spring rods incorporated in the blanket which extend between the bracket and the sealing ring.

12 Claims, 2 Drawing Sheets

RESILIENT ROTARY DRYER SEAL

FIELD OF THE INVENTION

This invention relates generally to rotary drum dryers and more particularly to the seal between the rotating drum and stationary portions of a dryer.

BACKGROUND OF THE INVENTION

Rotary drum dryers for drying bulk solids are well-known in the art and generally consist of a horizontal drum which is rotated about its horizontal axis and associated with a heating source for drying material loaded into the drum. Drum dryers are typically heated by firing a burner along the axis of the drum or by directing combustion gas into the drum through one end. In many instances it is desirable to control the flow of gases into and out of the dryer drum. In particular, when drying combustible materials, it is often desirable to control the oxygen content in the drum to prevent combustion of the material being dried.

Rotary dryer drums are used, for example, in the wood processing industry, to dry hogfuel and other wood wastes for boiler fuel or to dry wood strands for strand board production. Such dryer drums are typically sealed to a combustion gas inlet plenum and an exhaust gas outlet plenum. The gases which are supplied by the inlet plenum are typically combustion gases depleted in oxygen. The interior of the drum typically runs at a negative pressure produced by the natural or forced draft of the exhaust gas chimney. Existing dryers utilize resilient, flexible seals which are mounted on the non-moving parts of the dryer and ride on a sealing ring mounted on the rotating drum. These existing drum dryer seals have been typically manufactured of built-up layers of fiberglass or ceramic cloth treated with silicone rubber. While these seals function quite satisfactorily when the dryer is initially introduced into service, over time problems can rise.

The prior art seals are initially resilient and are installed so that they are biased by their resiliency against the sealing ring. The seals, while normally running relatively cool, will on occasion be subject to temperatures as high as 1500 degrees Fahrenheit. Because the drum is normally under negative pressure, hot combustion gases do not normally impinge upon the seals. However, on occasion, the drum outlet can become clogged and combustion gases will back up through the seals subjecting them to high temperatures.

In practice, these conditions have meant that after a few months, the prior art seals loose some of their resiliency and thus are no longer effective at sealing outside air from the interior of the rotating drum. The problem of obtaining a good seal between the dryer and the inlet plenum is further aggravated by the tendency of rotating drum dryers to be slightly eccentric about their axes of rotation. This eccentricity tends to increase with age of the dryer as wear of the dryer trunnions and other components tends to increase the eccentricity of the dryer drum.

Another factor which tends to make sealing the rotating drum difficult is the changes in size of the drum with changes in temperature, as the drum upon heating tends to increase in diameter and length. What is needed is a rotary drum dryer seal which remains resilient and functional after prolonged exposure to high temperatures.

SUMMARY OF THE INVENTION

The drum dryer seal of this invention employs a sealing strip built up of six layers of high-temperature ceramic cloth to form a blanket, the top layer of the seal being constructed of aluminized, high-temperature barrier yarn. The top layer prevents the infiltration of air through the seal. A high-temperature rubber belt material may be added to cover the sealing strip and thus better distribute the load of a clamp as will hereinafter be described.

The blanket forming the seal extends between a bracket on the non-moving part of a rotary drum dryer and a sealing ring mounted on the dryer drum. The blanket is clamped to the non-rotating portion of the dryer between the bracket and a clamping strip by bolts which pass through the bracket and the clamping strip.

The clamping bolts also hold a plurality of C-shaped retention brackets. The retention brackets have bottom legs which are clamped by the clamping bolts to the bracket. The retention brackets have upper legs which retain resilient spring members that extend out over the blanket. The blanket overlies the sealing ring mounted on the rotating drum. A plunger, mounted to each resilient spring member and positioned over the sealing ring, biases the blanket against the sealing ring thus producing a resilient, heat-resistant drum seal.

An alternative embodiment employs stainless steel spring rods incorporated in the blanket that extends between the bracket and the sealing ring.

It is a feature of the present invention to provide a seal between the non-moving and moving portions of a rotary drum dryer.

It is another feature of the present invention to provide a rotary drum dryer seal which resists air infiltration.

It is a further feature of the present invention to provide a rotary drum dryer seal which remains functional despite extended exposure to high temperatures.

It is also a feature of the present invention to provide a rotary drum dryer seal which can accommodate an eccentrically mounted rotary drum.

It is a still further feature of the present invention to provide a rotary drum dryer seal which can accommodate the dimensional changes of a dryer drum as it is heated and cooled.

Further objects, features, and advantages of the invention will be apparent from the following detailed description taken in conjunction with the accompanying drawings.

DESCRIPTION OF THE PREFERRED EMBODIMENTS

Figure 1:
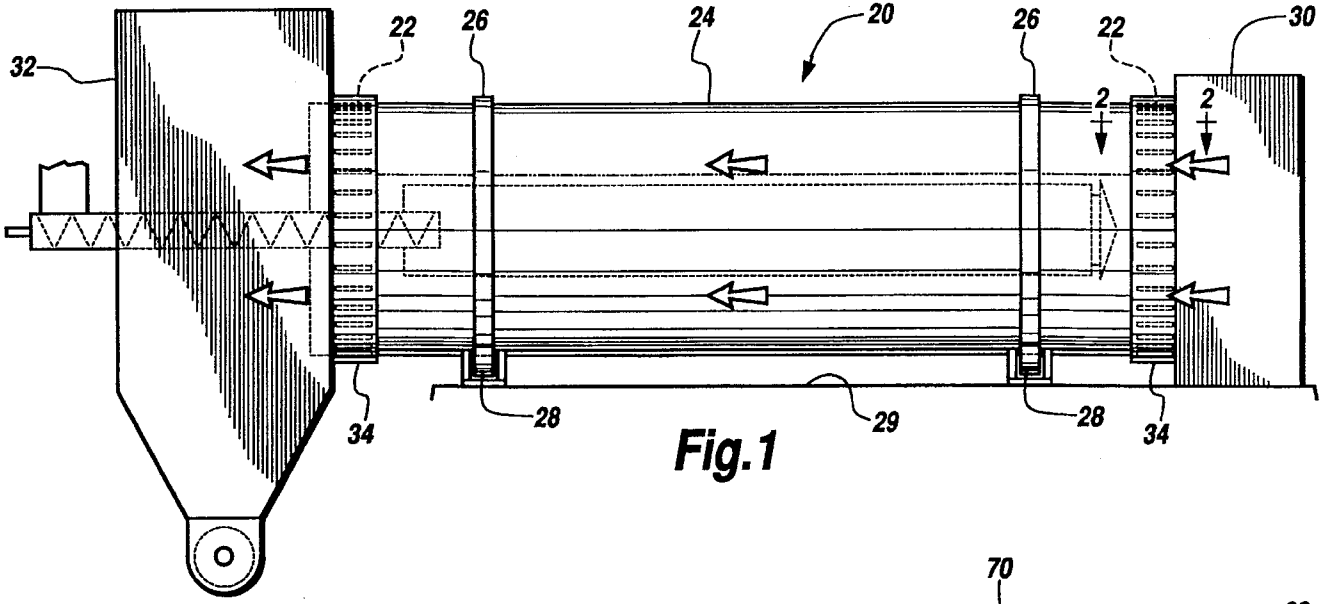
FIG. 1 is a side elevational view of a rotary drum dryer having the seal of this invention.
Figure 2:
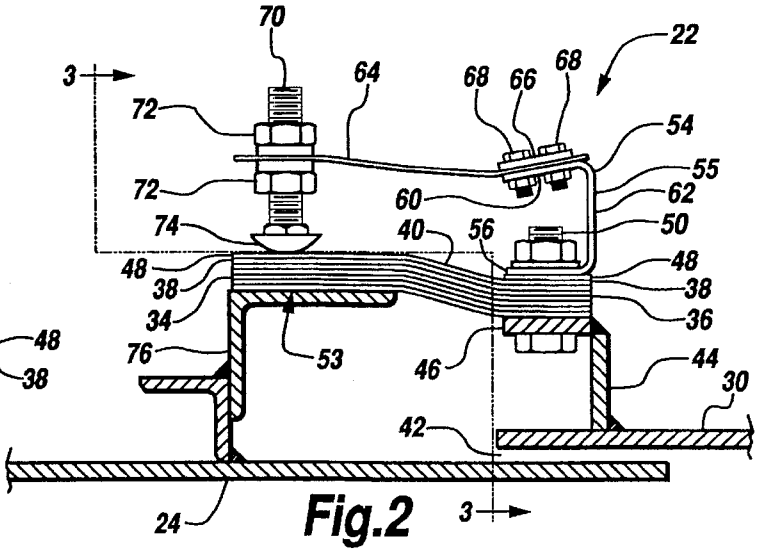
FIG. 2 is a cross-sectional view of the drum dryer seal of the dryer of FIG. 1 taken along section line 2—2.
Figure 3:
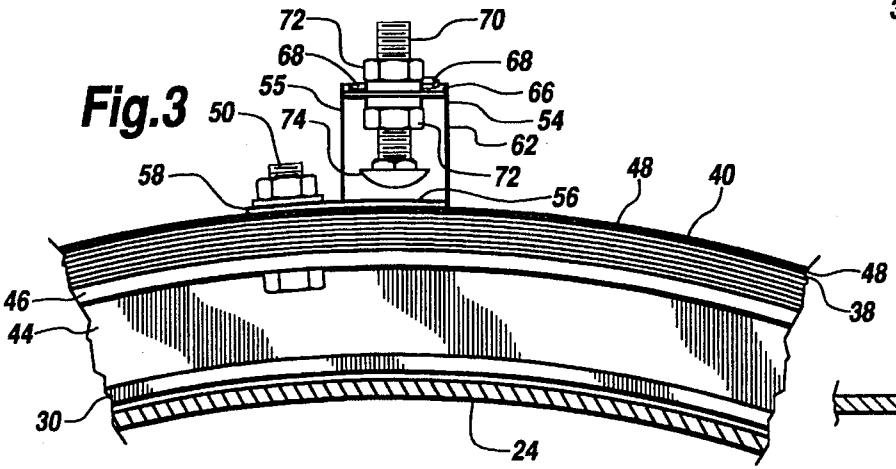
FIG. 3 is a cross-sectional view of the dryer seal of FIG. 2 taken along section line 3—3.
Figure 4:
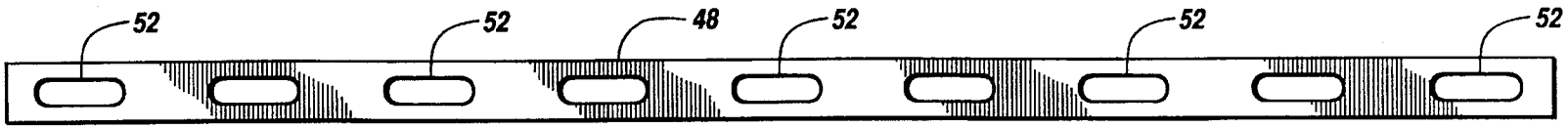
FIG. 4 is a clamping strip employed in holding the sealing strip blanket clamped to the non-moving portions of a dryer drum.

Referring more particularly to FIGS. 1–5, wherein like numbers refer to similar parts, a rotary drum dryer 20 is shown in FIG. 1 which employs dryer seals 22, best shown in FIGS. 2–4.

The dryer 20 has a cylindrical drum 24. The drum 24 has tires 26 which rest on and are driven by trunnions 28. The trunnions 28 are mounted to a base 29. A hot gas inlet plenum or duct 30 supplies hot gases which move through the drum 24 into an exhaust outlet duct 32. Dryer seals 22 are located between the inlet duct 30 of the drum 24 and between the drum and the outlet duct 32. The seals 22 are continuous and surround the drum 24 about its circumference.

As shown in FIG. 2 in cross-section, each seal 22 is formed of a multi-layer blanket 34. The blanket 34 is composed of five ceramic cloth layers of Zetex Plus style 2500ZP high-texturized silica-based yarn 36 and, one layer of aluminized, high-temperature barrier yarn 38, which is superimposed upon the five ceramic cloth layers. Further, a one-eighth inch thick high-temperature rubber belt material 40 may be added on top of the blanket 34. The five ceramic cloth layers 36 plus the one aluminized layer 38 of the blanket 34 are joined together using high-strength Inconel thread. The blanket 34 is prefabricated and may be obtained from Bussard and Sons of Albany, Oreg. The overlying optional high-temperature rubber belt material 40 is conventional.

The blanket 34 completely encircles a joint 42 between the inlet duct 30 and the drum 24. On the non-moving side of the joint 42, the blanket 34 is clamped to a bracket 44 having a cylindrical attachment ring 46 which surrounds the inlet duct. The blanket 34 is clamped between the attachment ring 46 and a plurality of clamping bracket assemblies 55 by a plurality of clamping bolts 50. A retention clamping strip 48 overlies the blanket 34 beneath the clamping bracket assemblies 55. The clamping strip 48, best shown in FIG. 4, has large, elongated bolt holes 52 which facilitate the replacement of the seals 22 in the field. Further, the elongated holes 52 allow for slight irregularity in the placement of the attaching bolts along the attachment ring 46.

The blanket 34 which forms the seal 22 is circumferential in nature and extends completely around the drum 24 to seal the joint 42. The blanket 34 extends and overlies a sealing ring 53 of the rotary drum 24.

The clamping bracket assemblies 55 are spaced along the circumference of the dryer seal 22. Each bracket assembly 55 has a retention bracket 54 which supports a spring biased plunger. The retention brackets 54 are C-shaped in cross-section as shown in FIG. 2. Each C-shaped retention bracket 54 has a lower leg 56 which extends axially along the attachment ring 46. An extension segment 58 protrudes circumferentially from the lower leg 56 and has an elongated hole (not shown) which allows movement of the retention bracket 54 away from and towards the joint 42. The bolt 50 passes through the hole in the lower leg extension segment 58. The retention bracket 54 has a back 62 which extends radially outwardly from the lower leg and which supports an upper leg 60 above the blanket 34. The upper leg 60 is bent downwardly towards the bottom leg 56 to form an angle of approximately seventy seven degrees with the back 62 of the retention bracket 54.

A spring 64 is clamped between the upper leg 60 and a spring clamp 66 by staggered bolts 68. The spring 64 is approximately one and one half inches wide in the circumferential direction and extends seven and one half inches across and above the blanket 34 and the sealing ring 53. A plunger 70 which is comprised of a carriage bolt passes through the spring 64 and is adjustably positioned thereon by clamping nuts 72. The carriage bolt plunger 70 has a head 74 that is biased downwardly by the spring 64. The spring 64 is constructed of one-sixteenth inch standard clock spring steel and is protected from rust by an epoxy paint coating. Because the blanket 34 is constructed entirely of high-temperature resistant materials, continual long-term exposure to high temperatures does not affect its flexibility or other characteristics. Further, the aluminized layer 38 prevents the ingress of air while it is itself protected from extremely high temperatures by the underlying ceramic cloth layers 36.

The sealing ring 53 is mounted to the drum by a bracket 76 and is ground smooth after installation on the drum 24. Because the ceramic cloth 36 which makes up the blanket 34 is ceramic in nature, it tends to produce a polish on the surface of the sealing ring 53 after several days run. The sealing ring 53 once polished has a reduced tendency to wear away the blanket 34. The resiliency of the seal 22 remains approximately constant over time because the resilient force is supplied by the spring 64 which is stood off from the hot surface of the drum 24 and is further not easily affected by temperature. Further, a larger range of resiliency is available than in previous sealing arrangements, better accommodating eccentricity and thermal expansion of the drum 24.

The blanket 34 on the fixed side of the seal 22 should normally be clamped by the clamping bracket 55 to the non-rotating side of the joint 42 for safety reasons. Because the clamping bracket 55 is stationary, the hazards to personnel are reduced in that the only rotating surfaces on the drum dryer 20 are smooth and regular. The high-temperature rubber belt material 40 is added to cover the blanket to better distribute the load of the clamping bracket 55.

Figure 5:
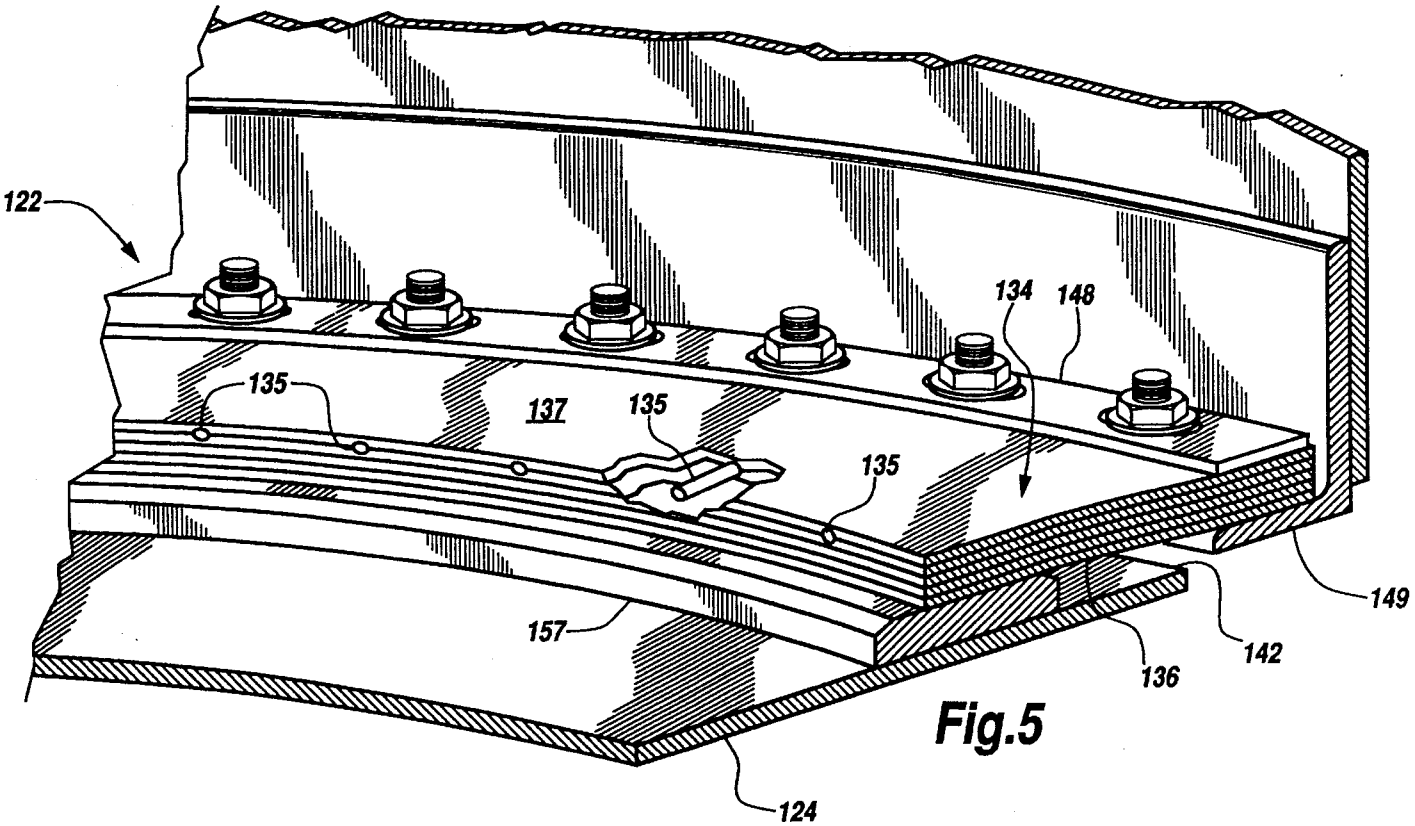
FIG. 5 is a cut-away isometric view of a portion of an alternative embodiment dryer drum sealing strip blanket of this invention.

An alternative embodiment dryer seal 122 is shown is shown in FIG. 5 having a blanket 134 which is composed of ceramic layers 136 stitched together similar to the sealing blanket 34 shown in FIG. 2. However, the seal 122 has resilient stainless steel spring rods 135 which bias the blanket 134 against a sealing ring 157 which is fixed to the rotating drum 124. The blanket 134 is clamped between a bracket 149 and a clamping strip 148, similar to the clamping strip 48 shown in FIG. 6. The rods 135 are internal to the blanket 134 and extend axially across a joint 142. However, the rods 135 are located near the top 137 of the blanket 134, so that they are partially protected from high temperatures. The blanket 134 overlies a sealing ring 157 which is mounted to a dryer drum 124.

It should be noted that although the blankets 34 and 134 are described as stitched together with high temperature Inconel thread, they could be stitched together using any high temperature thread.

It should also be understood that the dryer seals 22 and 122 could be used on either hogfuel or directly fired rotary dryers. It should be further understood that the blankets 34 and 134 may be continuous about the circumference of the drum or may be made up of discreet segments. Again it should be understood that while the bolts 50 of the clamping bracket 55 are preferably spaced about six inches apart, they could be employed with various spacings.

It should be understood that although spring 64 is shown as a thin plate it could be a coil spring or a bar spring.

It should be understood that the invention is not limited to the particular construction and arrangement of parts herein illustrated and described, but embraces such modified forms thereof as come within the scope of the following claims.

We claim:

1. In a rotary drum dryer having a dryer drum mounted for rotation to a base and having a circumferential sealing ring connected to the drum, and a duct mounted to the base and spaced from the drum and supplying heating gas to the drum, wherein the improvement comprises a gas seal extending between the drum and the duct comprising:

a clamp mounted to, the duct;

a blanket having a plurality of layers, wherein an edge of the blanket is clamped to the duct by the clamp, and wherein portions of the blanket overlie the sealing ring on the rotating drum; and at least one spring engaged with the blanket to bias the blanket against the sealing ring.

2. The rotary drum dryer of claim 1 wherein the spring comprises a plurality of spring rods which extend between the clamp and the sealing ring and are clamped along with the blanket by the clamp.

3. The rotary drum dryer of claim 1 further comprising a bracket which extends radially outwardly from clamp, wherein the spring extends axially from the bracket and is spaced above the blanket, and wherein the spring includes a plunger member which extends radially inwardly to engage and resiliently bias the blanket toward the sealing ring.

4. The rotary drum dryer of claim 1 wherein the blanket has an upper layer which is metal coated to render it less permeable to gases.

5. The rotary drum dryer of claim 3 wherein a sheet of rubber belt material overlies the blanket to distribute the load of the plungers over the blanket.

6. The rotary drum dryer of claim 1 wherein a plurality of springs are spaced about the circumference of the blanket to bias the blanket against the sealing ring.

7. In a rotary drum dryer having a dryer drum rotatably mounted to a base and having a circumferential sealing ring mounted thereto, a duct fixed to the base and supplying heating gas to the drum, the improvement comprising:

a clamp mounted to the duct;

a multi-layered blanket of a selected thickness having a first edge retained by the clamp and portions which extend axially to overlie the sealing ring;

a plurality of radially inwardly extending members which engage against the multi-layered blanket; and a plurality of resilient members fixed to the duct, wherein an inwardly extending member is connected to each resilient member, and wherein the resilient members bias the inwardly extending members against the blanket above the sealing ring to thereby define a gas seal between the rotating drum and the fixed duct.

8. The rotary drum dryer of claim 7 wherein the clamp has portions which extend radially outwardly from the duct, and wherein one of said plurality of resilient members is connected to each clamp at a position spaced radially outwardly from the duct.

9. The rotary drum dryer of claim 7 wherein the resilient member comprises a strip of spring steel.

10. The rotary drum dryer of claim 7 wherein the blanket has an upper layer which is metal coated to render it less permeable to gases.

11. The rotary drum dryer of claim 7 wherein a sheet of rubber belt material overlies the blanket to distribute the load of the radially inwardly extending members over the blanket.

12. The rotary drum dryer of claim 7 wherein a plurality of resilient members are spaced about the circumference of the blanket to bias the blanket against the sealing ring.

* * * * *